US011011286B2

(12) United States Patent
Huang et al.

(10) Patent No.: US 11,011,286 B2
(45) Date of Patent: May 18, 2021

(54) CABLE

(71) Applicant: Hitachi Metals, Ltd., Tokyo (JP)

(72) Inventors: Detian Huang, Tokyo (JP); Yoshinori Tsukamoto, Tokyo (JP); Masanori Kobayashi, Tokyo (JP); Masashi Moriyama, Tokyo (JP); Isao Matsuoka, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/514,809

(22) Filed: Jul. 17, 2019

(65) Prior Publication Data

US 2020/0185125 A1 Jun. 11, 2020

(30) Foreign Application Priority Data

Dec. 10, 2018 (JP) ..... JP2018-230772
Dec. 11, 2018 (JP) ..... JP2018-231823
Dec. 11, 2018 (JP) ..... JP2018-231824

(51) Int. Cl.

| | |
|---|---|
| ***H01B 7/24*** | (2006.01) |
| ***H01B 7/00*** | (2006.01) |
| ***H01B 7/18*** | (2006.01) |
| ***H01B 3/44*** | (2006.01) |
| ***H01B 3/30*** | (2006.01) |

(52) U.S. Cl.

CPC ..... *H01B 7/24* (2013.01); *H01B 3/302* (2013.01); *H01B 3/443* (2013.01); *H01B 7/0009* (2013.01); *H01B 7/1875* (2013.01)

(58) Field of Classification Search

CPC ..... H01B 7/24
USPC ..... 174/27
See application file for complete search history.

(56) References Cited

U.S. PATENT DOCUMENTS

| | | | | |
|---|---|---|---|---|
| 9,088,074 | B2 * | 7/2015 | Heiks | G02B 6/4415 |
| 2004/0096168 | A1 * | 5/2004 | Wells | G02B 6/4432 385/113 |
| 2012/0018212 | A1 * | 1/2012 | Wu | H02G 3/20 174/40 R |

(Continued)

FOREIGN PATENT DOCUMENTS

| | | | | |
|---|---|---|---|---|
| JP | 59-040408 | * | 8/1982 | H01B 7/18 |
| JP | S59-040408 | A | 3/1984 | |

(Continued)

OTHER PUBLICATIONS

Japanese Office Action, dated Feb. 19, 2019, in Japanese Application No. 2018-231823 and English Translation thereof.

(Continued)

*Primary Examiner* — Stanley Tso
(74) *Attorney, Agent, or Firm* — McGinn I.P. Law Group, PLLC.

(57) ABSTRACT

A cable includes a plurality of electric wires, which are laid helically around a center of the cable and along a central axis of the cable, and a sheath provided to cover respective peripheries of the plurality of electric wires together. The sheath includes an inner layer sheath made of a urethane resin, and an outer layer sheath provided around an outer periphery of the inner layer sheath to protect the inner layer sheath. The cable may further include a core member at its center. The sheath may be composed of a single layer instead of plural layers.

19 Claims, 3 Drawing Sheets

(56) References Cited

U.S. PATENT DOCUMENTS

2015/0279515 A1* 10/2015 Huang ..... A61L 31/041
174/72 A

FOREIGN PATENT DOCUMENTS

| | | | | | |
|---|---|---|---|---|---|
| JP | S64-20981 | U | | 2/1989 | |
| JP | 2014-010979 | | * | 6/2012 | ..... H01B 7/18 |
| JP | 4979075 | B2 | | 7/2012 | |
| JP | 2014-010979 | A | | 1/2014 | |
| JP | 2015-191705 | A | | 11/2015 | |
| JP | 2016-157666 | A | | 9/2016 | |
| KR | 20140137297 | | * | 12/2014 | |

OTHER PUBLICATIONS

Japanese Office Action, dated Feb. 19, 2019, in Japanese Application No. 2018-231824 and English Translation thereof.

* cited by examiner

CABLE

CROSS-REFERENCE TO RELATED APPLICATION

The present invention is based on Japanese Patent Application No. 2018-230772 filed on Dec. 10, 2018, Japanese Patent Application No. 2018-231823 filed on Dec. 11, 2018, and Japanese Patent Application No. 2018-231824 filed on Dec. 11, 2018, the entire contents of which are incorporated herein by reference.

BACKGROUND OF THE INVENTION

1. Field of the Invention

The present invention relates to a cable.

2. Description of the Related Art

In recent years, as an industrial robot used in a factory and the like, a SCARA robot (horizontal multi-articulated robot) with an arm to perform horizontal direction movement has been widely used. In the SCARA robot, a cable is often provided while remaining bent in an arch shape from a tip section to a base end section of the arm and over a movable part of the arm.

Note that Japanese Patent No. 4979075 has been disclosed as prior art document information relevant to the invention of the present application.

[Patent Document 1] Japanese Patent No. 4979075

SUMMARY OF THE INVENTION

In the above-described SCARA robot and the like, when the arm thereof performs a high speed movement, the cable routed in the arch shape is swung by the movement of the arm. The cable is repeatedly swung at high speed with repeated high speed movements of the arm. Although the cable when swung is subjected to a stress in a direction in which the cable is swung, the cable is unresistant to the stress and is excessively deflected, leading to the cable failing to be swung while following the high speed movement of the arm, and besides, cable wire break is highly likely to occur in a terminal section of the cable in which the stress is concentrated.

For the purpose of suppressing the occurrence of wire break in the terminal section of the cable, enlarging a bush to cover a periphery of the cable in the terminal section of the cable can be considered, but in this case, ensuring a space to set the bush is required leading to a restriction in design, or the flexibility in motion of the cable when the cable follows the high speed movement of the arm may lower.

Accordingly, it is an object of the present invention to provide a cable, which, even when being wired in an arch shape over a movable part, is resistant to being deflected when swung by a high speed movement of the movable part, and resistant to the occurrence of wire break.

For the purpose of solving the above-described problem, one aspect of the present invention provides a cable comprising: a plurality of electric wires, which are laid helically around a center of the cable and along a central axis of the cable; and a sheath provided to cover respective peripheries of the plurality of electric wires together, wherein the sheath includes an inner layer sheath comprising a urethane resin, and an outer layer sheath provided around an outer periphery of the inner layer sheath to protect the inner layer sheath.

Another aspect of the present invention provides a cable comprising: a core member comprising a resin and being provided in a center of the cable; a plurality of electric wires, which are laid helically around an outer periphery of the core member; and a sheath provided to cover respective peripheries of the plurality of electric wires together, wherein the core member includes a core member main body, which is elastic and harder than the plurality of electric wires, and a coating layer provided around an outer periphery of the core member main body to coat the core member main body, wherein the sheath includes an inner layer sheath comprising a urethane resin, and an outer layer sheath provided around an outer periphery of the inner layer sheath to protect the inner layer sheath.

According to still another aspect of the present invention provides a cable comprising: a core member comprising a resin and being provided in a center of the cable; a plurality of electric wires, which are laid helically around an outer periphery of the core member; and a sheath provided to cover respective peripheries of the plurality of electric wires together, wherein the core member includes a core member main body, which is elastic and harder than the plurality of electric wires, and a coating layer provided around an outer periphery of the core member main body to coat the core member main body.

Points of the Invention

According to the present invention, it is possible to provide the cable, which, even when being wired in an arch shape over a movable part, is resistant to being deflected when swung by a high speed movement of the movable part, and resistant to the occurrence of wire break.

DETAILED DESCRIPTION OF THE PREFERRED EMBODIMENTS

Embodiments of the present invention will be described below in conjunction with the attached drawings.

First Embodiment

Figure 1:
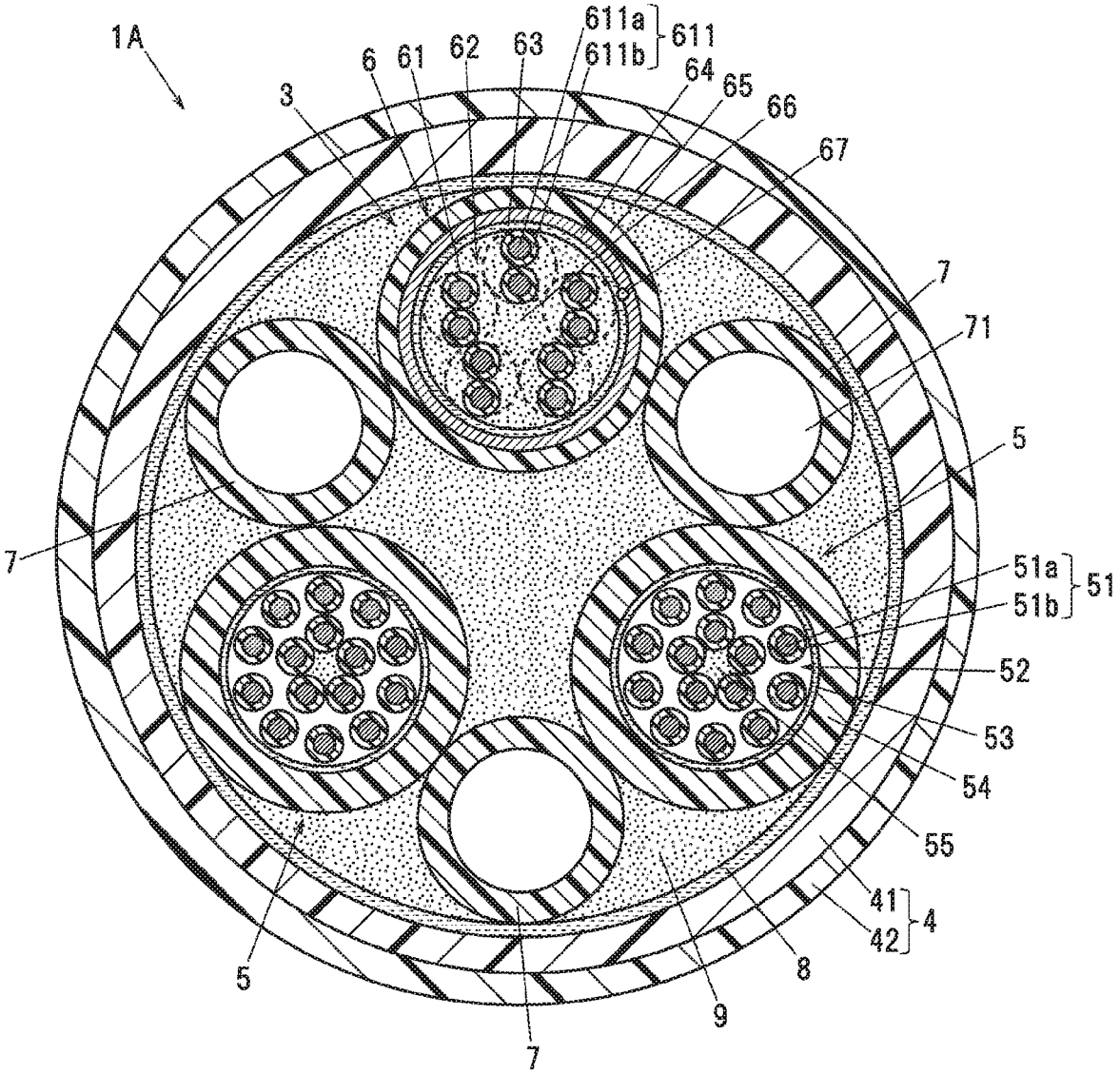
FIG. 1 is a cross sectional view showing a cross section perpendicular to a longitudinal direction of a cable according to a first embodiment of the present invention.

FIG. 1 shows a cross section perpendicular to a longitudinal direction of a cable 1A according to the present embodiment. The cable 1A is configured to be arranged in, e.g., an industrial robot such as a SCARA robot and the like, while remaining bent in an arch shape over a movable portion of an arm such as a joint and the like.

As shown in FIG. 1, the cable 1A is configured to include a plurality of electric wires 3, which are laid helically around a center of the cable 1A and along a central axis of the cable 1A, and a sheath 4 provided to cover respective peripheries of the plurality of electric wires 3 together.

The plurality of electric wires 3 are configured to include two power supply wires 5, which are designed for electric power supply, and a signal wire 6, which is designed for signal transmission. Although herein are described the two power supply wires 5 and one signal wire 6 being included as the plurality of electric wires 3, the numbers of the power supply wires 5 and the signal wire 6 are not limited thereto, but an electric wire other than the power supply wires 5 and the signal wire 6 may be included as the plurality of electric wires 3.

The power supply wires 5 are respectively configured to include a respective plurality of insulated electric wires 51, which are respectively formed by coating an outer periphery of a stranded wire conductor 51*a* composed of stranded wires (wires each having an outer diameter of e.g. 0.12 mm or less) made of a good electrical conductor such as copper or the like, with an insulator 51*b* made of a fluorine resin such as an ETFE (tetrafluoroethylene-ethylene copolymer), an FEP (tetrafluoroethylene-hexafluoropropylene copolymer), a PFA (tetrafluoroethylene-perfluoroalkylvinylether copolymer) or the like, a binder tape 53, which is helically wrapped around an outer periphery of an aggregate 52, which is formed by stranding the respective plurality of insulated electric wires 51, and a first inner sheath 54 provided around an outer periphery of the binder tape 53 to cover the aggregate 52 together (collectively). As the binder tapes 53, a paper tape, a tape made of a non-woven fabric cloth or the like can be used. As the first inner sheaths 54, a sheath made of a polyvinyl chloride (PVC) resin or the like can be used, for example.

In the present embodiment, the aggregate 52 in each power supply wire 5 is formed by using fifteen of the insulated electric wires 51 in total, in such a manner that five of the insulated electric wires 51 are helically wound around a periphery of a filler 55 provided in a central portion of each power supply wire 5, while ten of the insulated electric wires 51 are further helically wound around an outer periphery of the five insulated electric wires 51. Note that the number of the insulated electric wires 51 constituting the aggregate 52 is not limited to this example. As the filler 55, a thread-like or band-like member made of a string, a paper, a non-woven fabric cloth or the like can be used, for example. Herein, a staple fiber yarn is used as the fillers 55. The filler 55 is provided to impregnate spaces lying between the five insulated electric wires 51 that are provided in a radial inner side of each power supply wire 5.

The signal wire 6 is designed for control signal transmission to be used in control of various devices such as control of an air injector. The signal wire 6 is configured to include a twisted wire pair aggregate 62, which are formed by stranding a plurality of twisted wire pairs 61 designed for signal transmission, a binder tape 63, which is helically wrapped around a periphery of the twisted wire pair aggregate 62, a shield layer 64 provided to cover a periphery of the binder tape 63, and a second inner sheath 65 provided around an outer periphery of the shield layer 64 to cover the twisted wire pair aggregate 62 together.

The twisted wire pairs 61 are respectively being formed by twisting insulated electric wire pairs 611 each including a stranded wire conductor 611*a* composed of stranded wires (wires each having an outer diameter of e.g. 0.12 mm or less) made of a good electrical conductor such as copper or the like and an insulator 611*b*, which is provided around an outer periphery of the stranded wire conductor 611*a* and made of a fluorine resin such as an ETFE (tetrafluoroethylene-ethylene copolymer), an FEP (tetrafluoroethylene-hexafluoropropylene copolymer), a PFA (tetrafluoroethylene-perfluoroalkylvinylether copolymer) or the like. Herein, the twisted wire pair aggregate 62 is formed by stranding five of the twisted wire pairs 61 and a filler 66. Note that the number of the twisted wire pairs 61 constituting the twisted wire pair aggregate 62 is not limited to this example. As the filler 66, a thread-like or band-like member made of a string, a paper, a non-woven fabric cloth or the like can also be used. Herein, a staple fiber yarn is used as the filler 66. The filler 66 is provided to impregnate spaces lying between the five twisted wire pairs 61 and the binder tape 63 covering the periphery of the five twisted wire pairs 61.

The plurality of twisted wire pairs 61 constituting the twisted wire pair aggregate 62 are configured to have respective twist pitch lengths (lay lengths) different from each other, in order to suppress the occurrence of crosstalk (noise) between the twisted wire pairs 61. Note that the twist pitch length (lay length) of the twisted wire pair 61 refers to the distance between adjacent points in a longitudinal direction of the twisted wire pair 61 where each of its insulated electric wires 611 lies at the same positions in a circumferential direction of the twisted wire pair 61.

In the present embodiment, a lay direction of each stranded wire conductor 611*a* of the insulated electric wire 611 and a lay direction of each twisted wire pair 61 are configured to be opposite directions to each other, while the lay direction of each twisted wire pair 61 and a lay direction of the twisted wire pair aggregate 62 are configured to be opposite directions to each other. The lay direction of each stranded wire conductor 611*a* of the insulated electric wire 611 and the lay direction of the twisted wire pair aggregate 62 are configured to be the same. This is because, if the lay direction of each twisted wire pair 61 is the same as the lay direction of each stranded wire conductor 611*a* of the insulated electric wires 611 and the lay direction of the twisted wire pair aggregate 62, the strands constituting each stranded wire conductor 611*a* are repeatedly twisted in the same direction, which may lead to strand necking and fracture during bending and the like. By configuring the lay direction of each twisted wire pair 61 in the opposite direction to the lay direction of each stranded wire conductor 611*a* of the insulated electric wire 611 and the lay direction of the twisted wire pair aggregate 62, it is possible to suppress the occurrence of wire break of the strands and enhance the resistance to bending.

Note that the lay direction of the stranded wire conductor 611*a* is defined as the direction in which the constituent strands of the stranded wire conductor 611*a*, when observed from one end side of the insulated electric wire 611, are turning from the other end side of the insulated electric wire 611 to the one end side. The lay direction of the twisted wire pair 61 is defined as the direction in which the insulated electric wires 611, when observed from one end side of the twisted wire pair 61, are turning from the other end side of the twisted wire pair 61 to the one end side. Further, the lay direction of the twisted wire pair aggregate 62 is defined as the direction in which the twisted wire pairs 61, when observed from one end side of the twisted wire pair aggregate 62, are turning from the other end side of the twisted wire pair aggregate 62 to the one end side.

As the binder tape 63, a paper tape, a tape made of a non-woven fabric cloth or the like can be used. The shield layer 64 is made of a braided shield in which metal wires are braided. A drain wire 67 to be used when the shield layer 64 is grounded is provided between the shield layer 64 and the binder tape 63. As the second inner sheath 65, a sheath made of a polyvinyl chloride (PVC) resin or the like can be used, for example.

The three electric wires 3, i.e., the two power supply wires 5 and the one signal wire 6 are adjusted appropriately to have their substantially equal outer diameters (outer diameters of 80% or more of the outer diameter of the thickest electric wire 3, for example). Note that the outer diameter of each electric wire 3 can be adjusted according to the respective thickness and the like of the first inner sheaths 54 or the second inner sheath 65.

The cable 1A is configured to include one or more air tubes 7, through which air is to be passed. The air tubes 7 are designed to be used to supply air to an air injector, for example, and are made of a urethane resin or the like. The air tubes 7 are formed in a hollow circular cylindrical shape including a hollow portion 71 in a longitudinal direction thereof, and are smaller in outer diameter than the plurality of electric wires 3 (the power supply wires 5 and the signal wire 6). Although herein is described the number of the air tubes 7 to be used being three which is the same as the number of the plurality of electric wires 3, the number of the air tubes 7 to be used is not limited to this example.

The three electric wires 3 and the three air tubes 7 are alternately arranged in a cable circumferential direction, and being helically laid (stranded) together. In order to suppress the occurrence of a laying failure such as an uneven laying and the like, it is desirable that the plurality of electric wires 3 and the air tubes 7 be arranged as evenly as possible (at as equal a pitch as possible) in the cable circumferential direction.

A binder tape 8 is helically wrapped around a periphery of the three electric wires 3 and the three air tubes 7 being stranded together. A paper tape, a tape made of a non-woven fabric cloth, or the like can be used as the binder tape 8. The sheath 4 is provided around an outer periphery of the binder tape 8. A thickness of the sheath 4 is preferably thicker than the thicknesses of the first inner sheaths 54 and the second inner sheath 65 of each electric wire 3, and can be set at on the order of e.g. 1.4 mm to 1.8 mm.

In the cable 1A, all the plurality of electric wires 3 are in contact with an inner peripheral surface of the binder tape 8. Further, the plurality of electric wires 3 and the air tubes 7 being adjacent to each other in the circumferential direction are in contact with each other.

Further, in the present embodiment, a thread-like or strip-like filler 9 is arranged in a center of the cable 1A, in such a manner that the plurality of electric wires 3, the air tubes 7 and the filler 9 are laid (stranded) helically around a periphery of the filler 9 being arranged in the center of the cable 1A. Since a stress resulting from bending is highly likely to be concentrated in the center of the cable 1A, by configuring the cable 1A in such a manner that the plurality of electric wires 3 and the air tubes 7 are not arranged in the center of the cable 1A, it is possible to suppress the occurrence of damage due to the bending of the plurality of electric wires 3 and the air tubes 7, and it is possible to suppress the occurrence of degradation in transmission properties of the plurality of electric wires 3.

As the filler 9, a thread-like or band-like member made of a string, a paper, a non-woven fabric cloth or the like can also be used. Herein, a staple fiber yarn is used as the filler 9. The filler 9 is provided to impregnate spaces lying between the plurality of electric wires 3, the air tubes 7, and the binder tape 8 covering the periphery of the plurality of electric wires 3 and the air tubes 7.

(Description of the Sheath 4)

In the cable 1A according to the present embodiment, the sheath 4 is configured to include an inner layer sheath 41 made of a urethane resin, and an outer layer sheath 42 provided around an outer periphery of the inner layer sheath 41 to protect the inner layer sheath 41. The inner layer sheath 41 made of the urethane resin imparts an elasticity to the cable 1A, and when the cable 1A is bent, the inner layer sheath 41 acts to produce such a restoring force as to allow the cable 1A to return to a linear shape. Further, since the inner layer sheath 41 made of a urethane resin is not sufficient in water resistance and oil resistance, the outer layer sheath 42 is covering the inner layer sheath 41 and acts to impart the water resistance and the oil resistance.

Further, the outer layer sheath 42 is configured to further enhance the restoring force of the sheath 4 while maintaining the restoring force of the inner layer sheath 41 (without lowering the restoring force of the inner layer sheath 41). A thickness of the inner layer sheath 41 may be not less than a thickness of the outer layer sheath 42 in order to impart the sufficient elasticity (the restoring force to return to a linear shape) to the cable 1A, and in order to suppress an increase in cable 1A diameter. More preferably, the thickness of the inner layer sheath 41 may be larger than the thickness of the outer layer sheath 42, and still more preferably 1.2 times or thicker the thickness of the outer layer sheath 42.

The outer layer sheath 42 is provided around an outer periphery of the inner layer sheath 41 by tube extrusion coating the outer periphery of the inner layer sheath 41 with a resin. Note that, when the cable 1A is moved while following the high speed movement of the movable part, in order that the inner layer sheath 41 and the outer layer sheath 42 are integrally moved, it is preferable that the outer layer sheath 42 is adhered tightly to the inner layer sheath 41 in its portion contiguous to the surface of the inner layer sheath 41. In particular, it is preferable that the outer layer sheath 42 is adhered tightly to the inner layer sheath 41 in its portion contiguous to the surface of the inner layer sheath 41, so as to be moved integrally with the inner layer sheath 41. This results in suppressing the separation of the outer layer sheath 42 from the inner layer sheath 41 during repeated bendings. In the present embodiment, as the outer layer sheath 42, a sheath is used that is made of a polyvinyl chloride resin having a melting point relatively close to that of the urethane resin used for the inner layer sheath 41, so as to be able to be melted together with the inner layer sheath 41 and adhered tightly to the inner layer sheath 41 when covering the inner layer sheath 41.

By using the sheath 4 having the above described structure, when the cable 1A is bent and arranged in an arch shape, since the outer layer sheath 42 acts to complement the restoring force of the inner layer sheath 41 by producing such a restoring force as to allow the inner layer sheath 41 to return to a linear shape as a base for the restoring force of the sheath 4, it is possible to impart such a restoring force to the sheath 4 as to maintain the wiring shape of the cable 1A. As a result, even when the cable 1A is arranged in an arch shape over the movable part of the arm and the like, since it is possible to suppress a change in the wiring shape of the cable 1A being swung while following the high speed movement of the movable part and withstand the stress exerted in a direction in which the cable 1A is swung, the cable 1A becomes resistant to being deflected even when the movable part moves at high speed. As a result, the cable 1A is able to be repeatedly swung while following the high speed movement of the movable portion, with the stress exerted on a terminal section of the cable 1A being suppressed, so the cable 1A becomes resistant to the occurrence of wire break. Note that, in order to further suppress the deflection of the cable 1A, it is desirable to firmly fix an end portion of the sheath 4 to a device such as a SCARA robot or the like in the terminal section of the cable 1A. Further, by using the sheath 4 having the above described structure, when the cable 1A follows the high speed movement of the arm, the flexible motion of the cable 1A can be achieved.

Operations and Advantageous Effects of the First Embodiment

As described above, the cable 1A according to the present embodiment is configured to include the plurality of electric wires 3 laid (stranded) helically around the center of that cable 1A and along the central axis of the cable 1A, and the sheath 4 provided to cover the respective peripheries of the plurality of electric wires 3 together, wherein the sheath 4 is configured to include the inner layer sheath 41 made of a urethane resin, and the outer layer sheath 42 provided around the outer periphery of the inner layer sheath 41 to protect the inner layer sheath 41.

By having the above described sheath 4, it is possible to impart the elasticity (the restoring force to return to a linear shape) to the cable 1A, and when the cable 1A is bent and arranged in an arch shape, it is possible to maintain the shape of the cable 1A with the force to allow the cable 1A to return to a linear shape. As a result, it is possible to achieve the cable 1A which, when being wired in an arch shape over a movable part of an arm or the like of a SCARA robot or the like, is resistant to being deflected when swung even by a high speed movement of the movable part, and resistant to the occurrence of wire break.

Note that, for example, it is conceivable to increase the outer diameter of the cable to thereby suppress the occurrence of wire break in the terminal section, but that, in this case, the mass of the cable is increased leading to difficulty in following the high speed movement of the arm or the like. According to the present embodiment, the cable 1A being resistant to the occurrence of wire break can be achieved with no increase in outer diameter and mass, so its capability to follow the high speed movement is high.

Second Embodiment

Figure 2:
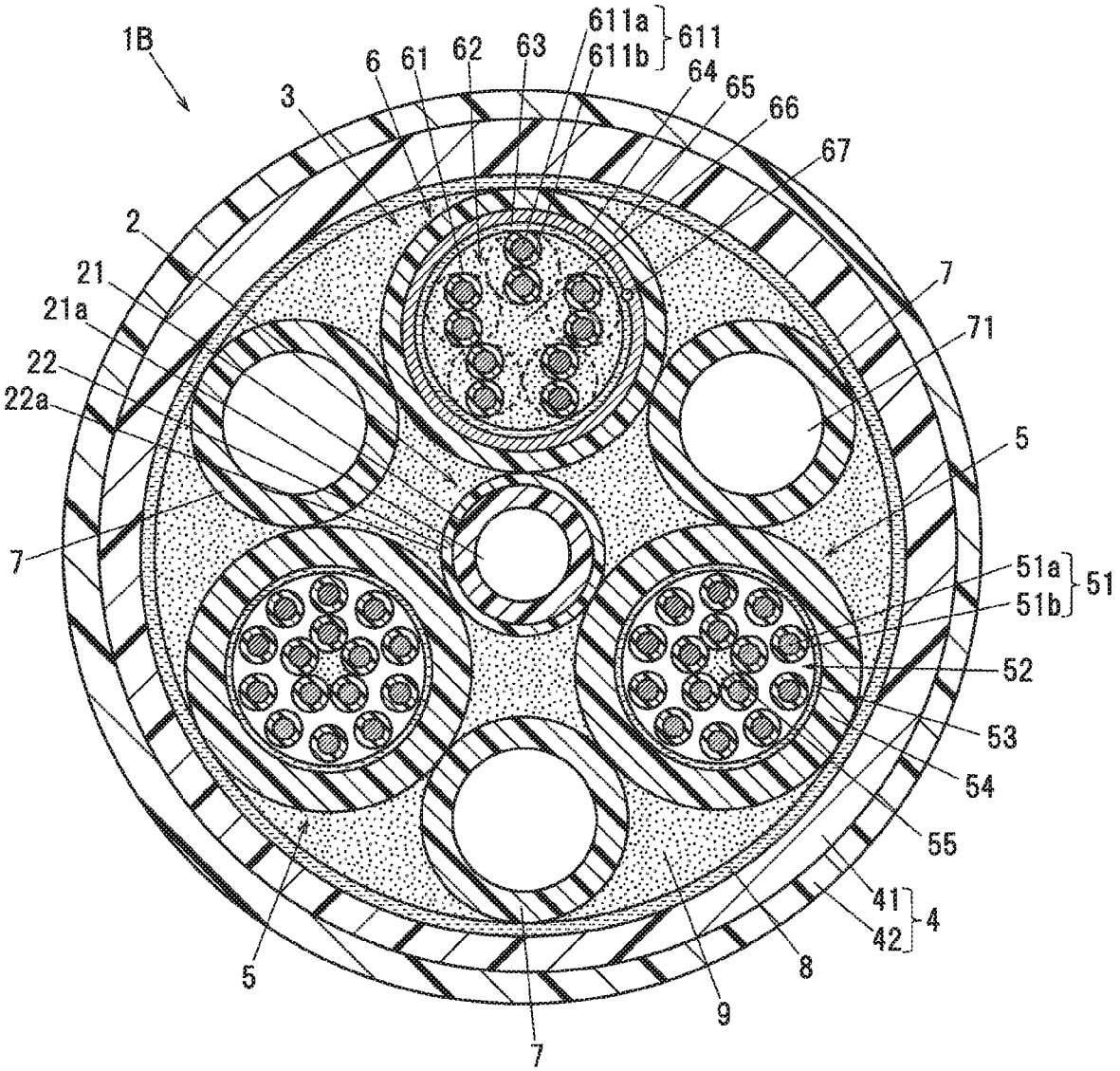
FIG. 2 is a cross sectional view showing a cross section perpendicular to a longitudinal direction of a cable according to a second embodiment of the present invention.

FIG. 2 is a cross-sectional view showing a cross section perpendicular to a longitudinal direction of a cable 1B according to a second embodiment. As described below, the second embodiment is configured in common with the first embodiment except that a core member 2 comprising a resin is provided in a center of the cable 1B. Accordingly, common or similar elements with or to those of the first embodiment are denoted by the same reference numerals, and their detailed descriptions are omitted.

As shown in FIG. 2, the cable 1B is configured to include a core member 2 comprising a resin and being provided in a center of the cable 1B, a plurality of electric wires 3, which are laid (stranded) helically around an outer periphery of the core member 2, and a sheath 4 provided to cover respective peripheries of the plurality of electric wires 3 together.

The plurality of electric wires 3 are configured in the same manner as those of the first embodiment.

The power supply wires 5 are also being configured in the same manner as those of the first embodiment.

The signal wire 6 is also being configured in the same manner as that of the first embodiment.

The three electric wires 3 and the three air tubes 7 are alternately arranged in a cable circumferential direction, and being laid (stranded) helically around an outer periphery of the core member 2. In order to suppress the occurrence of a laying failure such as an uneven laying and the like, it is desirable that the plurality of electric wires 3 and the air tubes 7 be arranged as evenly as possible (at as equal a pitch as possible) in the cable circumferential direction.

A binder tape 8 is helically wrapped around a periphery of the three electric wires 3 and the three air tubes 7 being laid (stranded) together. A paper tape, a tape made of a non-woven fabric cloth, or the like can be used as the binder tape 8. The sheath 4 is provided around an outer periphery of the binder tape 8. A thickness of the sheath 4 is preferably thicker than the thicknesses of the first inner sheaths 54 and the second inner sheath 65 of each electric wire 3, and can be set at on the order of 1.4 mm to 18 mm, for example.

In the cable 1B, all the plurality of electric wires 3 are in contact with an inner peripheral surface of the binder tape 8. Further, the plurality of electric wires 3 and the air tubes 7 being adjacent to each other in the circumferential direction are in contact with each other. Further, each electric wire 3 is in contact with the core member 2, while each air tube 7 is not in contact with the core member 2.

Further, the present embodiment is configured in such a manner that a filler 9, along with the plurality of electric wires 3 and the air tubes 7, is stranded over an outer periphery of the core member 2, with the binder tape 8 being wrapped around the periphery of the plurality of electric wires 3, the air tubes 7 and the filler 9 being stranded together. As the filler 9, a thread-like or band-like member made of a string, a paper, a non-woven fabric cloth or the like can also be used. Herein, a staple fiber yarn is used as the filler 9. The filler 9 is provided to impregnate spaces lying between the core member 2, the plurality of electric wires 3, the air tubes 7, and the binder tape 8 covering the periphery of the core member 2, the plurality of electric wires 3, and the air tubes 7.

(Description of the Core Member 2)

In the cable 1B according to the present embodiment, the core member 2 made of a resin is arranged in the center of the cable 1B. The core member 2 imparts a rigidity to the cable 1B, and even when the cable 1B is deflected (swung) from side to side while remaining bent and disposed in an arch shape, the core member 2 acts to suppress the excessive deflection of the cable 1B.

The core member 2 is configured to include a core member main body 21, and a coating layer 22 provided around an outer periphery of the core member main body 21 to coat the core member main body 21.

The core member main body 21 is made of a resin being elastic and harder (lower in flexibility, more resistant to bending) than the plurality of electric wires 3. That is, the core member main body 21 is made of a resin member having such a restoring force as to return to a linear shape when bent, and whose restoring force is higher than the restoring force of the plurality of electric wires 3. In the present embodiment, the core member main body 21 made of nylon is used. The core member main body 21 is preferably made of a resin harder than the coating layer 22 (harder than the coating layer 22 when compared in hardness indicated by Rockwell hardness and Shore hardness).

The coating layer 22 is configured to further enhance the restoring force of the above described core member 2 while maintaining the restoring force of the core member 21 (without lowering the restoring force of the core member 21). The coating layer 22 is also being designed to protect the core member main body 21. It is desirable that the coating layer 22 be as thin as possible in order to avoid an increase in diameter of the cable 1B. Specifically, a thickness of the coating layer 22 may be smaller than a thickness of the core member main body 21 (a radius of the core member main body 21 when the core member main body 21 is not hollow but solid). The coating layer 22 is provided around an outer periphery of the core member main body 21 by tube extrusion coating the outer periphery of the core member main body 21 with a resin. Note that, when the cable 1B is moved while following the high speed movement of the movable portion, in order that the core member main body 21 and the coating layer 22 are integrally moved, it is preferable that the coating layer 22 is adhered tightly to the core member main body 21 in its portion contiguous to the surface of the core member main body 21. In particular, it is preferable that the coating layer 22 is adhered tightly to the core member main body 21 in its portion contiguous to the surface of the core member main body 21, so as to be moved integrally with the core member main body 21.

By using the core member 2 having the above described structure, when the cable 1B is bent and arranged in an arch shape, since the coating layer 22 acts to complement the restoring force of the core member main body 21 by producing such a restoring force as to allow the core member main body 21 to return to a linear shape as a base for the restoring force of the core member 2, it is possible to impart such a restoring force to the core member 2 as to maintain the wiring shape of the cable 1B. As a result, even when the cable 1B is arranged in an arch shape over the movable part of the arm and the like, since it is possible to suppress a change in the wiring shape of the cable 1B being swung while following the high speed movement of the movable part and withstand the stress exerted in a direction in which the cable 1B is swung, the cable 1B becomes resistant to being excessively deflected. As a result, the cable 1B is able to be repeatedly swung while following the high speed movement of the movable portion, with the stress exerted on a terminal section of the cable 1B being suppressed, so the cable 1B becomes resistant to the occurrence of wire break. Note that, in order to further suppress the deflection of the cable 1B, it is desirable to firmly fix an end portion of the core member 2 to a device such as a SCARA robot or the like in the terminal section of the cable 1B. Further, by configuring the core member 2 as described above, even when using a member having such a high restoring force as to return to a linear shape as the core member main body 21, it is possible to make the cable 1B resistant to the occurrence of a lowering in the flexibility in motion of the cable 1B when the cable 1B follows the high speed movement of the arm.

Further, it is desirable that the core member main body 21 is formed in a hollow cylindrical shape (i.e., a tubular shape) including a hollow part 21*a* extending in a longitudinal direction thereof. This results in a decrease in the weight of the core member 2, thereby making it possible to suppress the deflection of the cable 1B during swinging from being easily caused by an increase in its weight. Further, by forming the core member main body 21 in a hollow cylindrical shape, it is possible to release the stress resulting from bending by the deformation of the core member main body 21, so the core member main body 21 becomes resistant to the occurrence of fracture, as compared with when the core member main body 21 is formed in a solid columnar shape.

An inner diameter and an outer diameter of the core member main body 21 may be set at respective appropriate values in such a range that an outer diameter of the core member 2 is smaller than outer diameters of the plurality of electric wires 3 and the air tubes 7 according to the thicknesses and the numbers of the plurality of electric wires 3 and the air tubes 7 being used. Herein, the inner diameter of the core member main body 21 is set at 4 mm, while the outer diameter of the core member main body 21 is set at 6 mm, and the thickness of the core member main body 21 is set at 1 mm. When using the core member main body 21 made of nylon, in order to maintain the bendability (flexibility) of the cable 1B, it is desirable to set the outer diameter of the core member main body 21 at 6 mm or less.

In the present embodiment, the coating layer 22 is configured as an abrasion suppressing layer 22*a* to suppress a friction between the plurality of electric wires 3 and the core member main body 21. The abrasion suppressing layer 22*a* is configured to suppress the occurrence of abrasion due to the friction between the core member main body 21 made of nylon and each electric wire 3.

The abrasion suppressing layer 22*a* may be configured as a resin being small in surface friction coefficient, highly slidable, and resistant to cracking and separation due to bending. In the present embodiment, as the abrasion suppressing layer 22*a*, a layer made of a resin containing a fluorine rubber and a fluorine resin is used. Note that, when the fluorine resin containing no rubber component is used as the abrasion suppressing layer 22*a*, cracking is highly likely to occur during bending.

As the resin containing a fluorine rubber and a fluorine resin, a fluorine rubber and fluorine resin containing resin having a mass ratio of the fluorine rubber and the fluorine resin of 95:5 to 20:80 may be used. Further, the fluorine resin preferably contains a polytetrafluoroethylene and a fusible fluorine resin at a mass ratio of 99.5:0.5 to 75:25. As the resin satisfying those mass ratios, DAI-EL (registered trademark) fluoro TPV available from Daikin Industries, Ltd may be used. By using this resin, it is possible to form the abrasion suppressing layer 22*a* having both an abrasion resistance and a low dust generation rate resulting from the action of the fluorine resin, and a flexibility and an elasticity (the elasticity to enhance the rectilinearity during U-shaped bending) resulting from the action of the fluorine rubber.

By including the abrasion suppressing layer 22*a*, it is possible to suppress the occurrence of abrasion of the core member main body 21 and the sheaths (the first inner sheath 54 and the second inner sheath 65) of the plurality of electric wires 3, and thereby achieve the long life cable 1B. A thickness of the abrasion suppressing layer 22*a* is e.g. 0.2 mm or more and 0.5 mm or less. Herein, the thickness of the abrasion suppressing layer 22*a* is set at e.g. 0.25 mm. The core member main body 21 is harder than the abrasion suppressing layer 22*a*, and thicker than the abrasion suppressing layer 22*a*.

(Description of the Sheath 4)

Further, in the cable 1B according to the present embodiment, the sheath 4 is configured to include an inner layer sheath 41 comprising a urethane resin, and an outer layer sheath 42 provided around an outer periphery of the inner layer sheath 41 to protect the inner layer sheath 41. The inner layer sheath 41 and the outer layer sheath 42 are configured in the same manner as those of the first embodiment.

Operations and Advantageous Effects of the Second Embodiment

As described above, the cable 1B according to the present embodiment is configured to include the core member 2 made of a resin and provided in the center of the cable 1B, the plurality of electric wires 3 laid (stranded) helically around the outer periphery of the core member 2, and the sheath 4 provided to cover the respective peripheries of the plurality of electric wires 3 together, wherein the core member 2 is configured to include the core member main body 21 being elastic and harder than the plurality of electric wires 3, and the coating layer 22 provided around the outer periphery of the core member main body 21 to coat the core member main body 21, wherein the sheath 4 is configured to include the inner layer sheath 41 made of a urethane resin, and the outer layer sheath 42 provided around the outer periphery of the inner layer sheath 41 to protect the inner layer sheath 41.

By including the core member 2 and the sheath 4 as described above, when the cable 1B is bent and arranged in an arch shape, it is possible to maintain the shape of the cable 1B with the force to allow the core member 2 and the sheath 4 to return to a linear shape. As a result, it is possible to achieve the cable 1B which, when being wired in an arch shape over a movable part of an arm or the like of a SCARA robot or the like, is resistant to being deflected when swung by a high speed movement of the movable part, and resistant to the occurrence of wire break. Note that, when only one of the core member 2 and the inner layer sheath 41 is included, the capability to follow the high speed movement of the movable portion may be insufficient, but that, by including both the core member 2 and the inner layer sheath 41, it is possible to achieve the high capability to be able to follow the higher speed movement as well.

Note that, for example, it is conceivable to increase the outer diameter of the cable to thereby suppress the occurrence of wire break in the terminal section, but that, in this case, the mass of the cable is increased leading to difficulty in following the high speed movement of the movable portion of the arm or the like. According to the present embodiment, the cable 1B being resistant to the occurrence of wire break can be achieved with no increase in outer diameter and mass, so its capability to follow the high speed movement is high.

Third Embodiment

Figure 3:
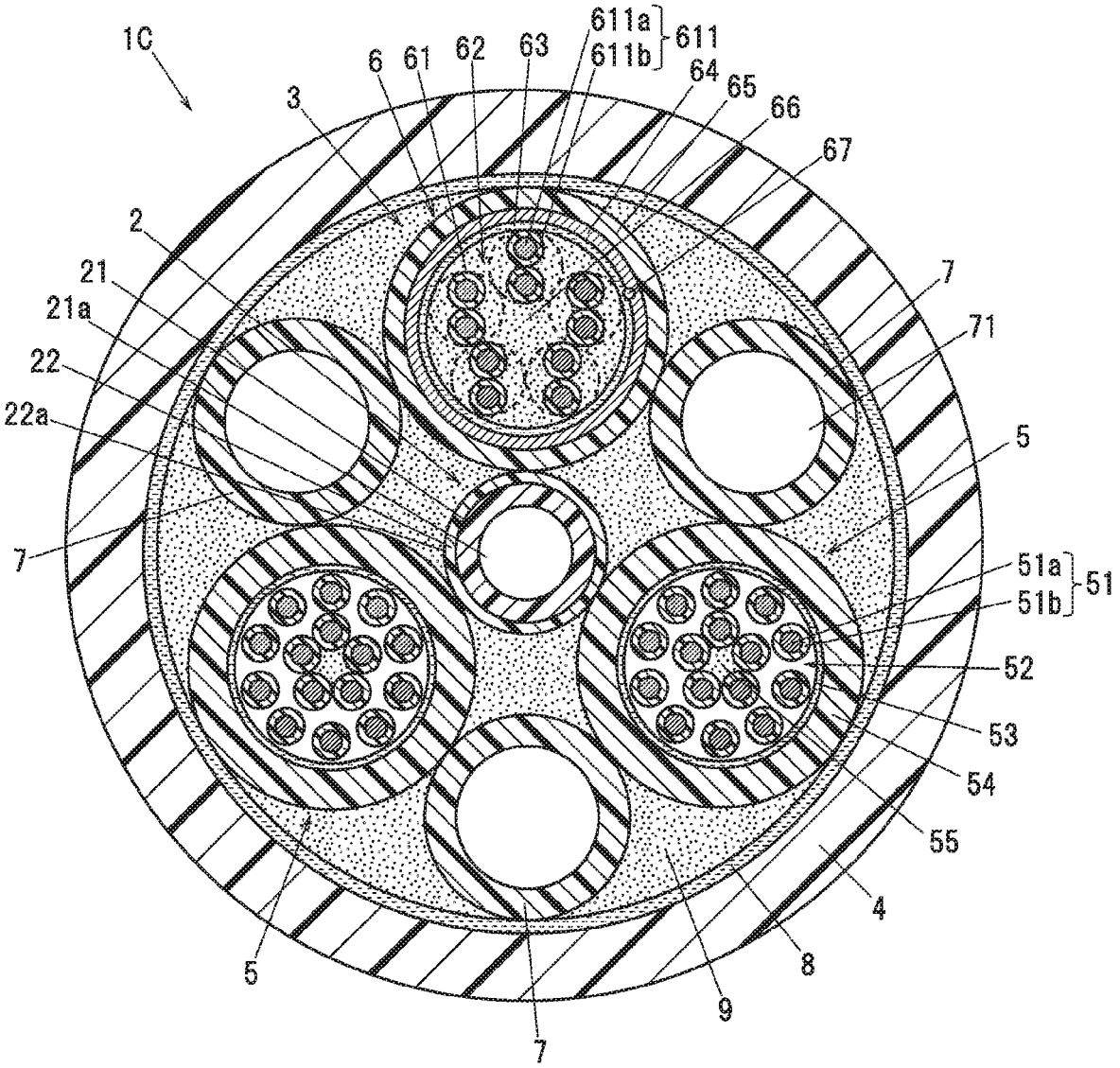
FIG. 3 is a cross-sectional view showing a cross section perpendicular to a longitudinal direction of a cable according to a third embodiment of the present invention.

FIG. 3 is a cross-sectional view showing a cross section perpendicular to a longitudinal direction of a cable 1C according to a third embodiment. As described below, the third embodiment is configured in common with the second embodiment except that the sheath 4 is configured as a single layer. Accordingly, common or similar elements with or to those of the second embodiment are denoted by the same reference numerals, and detailed descriptions thereof are omitted.

As shown in FIG. 3, the cable 1C is configured to include a core member 2 comprising a resin and being provided in a center of the cable 1C, a plurality of electric wires 3, which are laid (stranded) helically around an outer periphery of the core member 2, and a sheath 4 provided to cover respective peripheries of the plurality of electric wires 3 together. The sheath 4 is configured as a single layer.

The plurality of electric wires 3 are configured in the same manner as those of the second embodiment.

The power supply wires 5 are also being configured in the same manner as those of the second embodiment.

The signal wire 6 is also being configured in the same manner as that of the second embodiment.

Note that an outer diameter of each electric wire 3 is preferably larger than an outer diameter of the core member 2 described later, and can be set at on the order of 6 mm to 8 mm, for example.

The cable 1C is also being configured in the same manner as the cable 1B of the second embodiment in that it includes one or more air tubes 7, through which air is to be passed.

As the sheath 4 configured as a single layer, a single layer made of a polyvinyl chloride (PVC) resin or the like can be used, for example.

Operations and Advantageous Effects of the Third Embodiment

As described above, the cable 1C according to the present embodiment is configured to include the core member 2 made of a resin and provided in the center of the cable 1C, the plurality of electric wires 3 laid (stranded) helically around the outer periphery of the core member 2, and the sheath 4 provided to cover the respective peripheries of the plurality of electric wires 3 together, wherein the core member 2 is configured to include the core member main body 21 being elastic and harder than the plurality of electric wires 3, and the coating layer 22 provided around the outer periphery of the core member main body 21 to coat the core member main body 21.

By including the core member 2, when the cable 1C is bent and arranged in an arch shape, it is possible to maintain the shape of the cable 1C with the force to allow the core member 2 to return to a linear shape. As a result, it is possible to achieve the cable 1C which, when being wired in an arch shape over a movable part of an arm or the like of a SCARA robot or the like, is resistant to being deflected when swung even by a high speed movement of the movable part, and resistant to the occurrence of wire break.

Note that, for example, it is conceivable to increase the outer diameter of the cable to thereby suppress the occurrence of wire break in the terminal section, but that, in this case, the mass of the cable is increased leading to difficulty in following the high speed movement of the movable portion of the arm or the like. According to the present embodiment, the cable 1C being resistant to the occurrence of wire break can be achieved with no increase in outer diameter and mass, so its capability to follow the high speed movement is high.

Although the embodiments of the present invention have been described above, the above described embodiments are not to be construed as limiting the inventions according to the claims. Further, it should be noted that not all the combinations of the features described in the embodiments are indispensable to the means for solving the problem of the invention. Further, the present invention can appropriately be modified and implemented without departing from the spirit thereof.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A cable, comprising:

a core member provided in a center of the cable;

a plurality of electric wires, which are laid helically around the center of the cable and along a central axis of the cable; and a sheath provided to cover respective peripheries of the plurality of electric wires together, wherein the sheath includes an inner layer sheath comprising a urethane resin, and an outer layer sheath provided around an outer periphery of the inner layer sheath to protect the inner layer sheath, wherein the core member is consisted of a core member main body, which is elastic and harder than the plurality of electric wires, and a coating layer provided around an outer periphery of the core member main body to coat the core member main body, wherein the core member main body is consisted of a first resin and the coating layer is consisted of a second resin, wherein the core member main body has a hollow cylindrical shape including a hollow portion in a longitudinal direction of the cable, wherein an inside of the hollow portion is vacated, wherein the core member main body has a higher hardness than a hardness of the coating layer, wherein the coating layer includes an abrasion suppressing layer to suppress a friction between the plurality of electric wires and the core member main body, and wherein the plurality of electric wires and at least one air tube are provided equidistantly in a circumferential direction of the cable.

2. The cable according to claim 1, wherein the inner layer sheath and the outer layer sheath are adhered tightly to each other.

3. The cable according to claim 1, wherein the outer layer sheath comprises a polyvinyl chloride resin.

4. The cable according to claim 1, wherein a thickness of the inner layer sheath is not less than a thickness of the outer layer sheath, wherein the at least one air tube is for passing air, which is stranded together with the plurality of electric wires, and wherein the plurality of electric wires are laid helically around a periphery of a thread-like or a band-like filler.

5. A cable, comprising:

a core member provided in a center of the cable;

a plurality of electric wires, which are laid helically around an outer periphery of the core member; and a sheath provided to cover respective peripheries of the plurality of electric wires together, wherein the core member is consisted of a core member main body, which is elastic and harder than the plurality of electric wires, and a coating layer provided around an outer periphery of the core member main body to coat the core member main body, wherein the core member main body is consisted of a first resin and the coating layer is consisted of a second resin, wherein the core member main body has a hollow cylindrical shape including a hollow portion in a longitudinal direction of the cable, wherein an inside of the hollow portion is vacated, wherein the core member main body has a higher hardness than a hardness of the coating layer, wherein the coating layer includes an abrasion suppressing layer to suppress a friction between the plurality of electric wires and the core member main body, wherein the plurality of electric wires and at least one air tube are provided equidistantly in a circumferential direction of the cable.

6. The cable according to claim 5, wherein an outer diameter of the core member is smaller than an outer diameter of the plurality of electric wires.

7. The cable according to claim 5, wherein a thickness of the coating layer is smaller than a thickness of the core member main body.

8. The cable according to claim 5, wherein the core member main body comprises nylon.

9. The cable according to claim 5, wherein the coating layer comprises an insulator including a fluorine rubber and a fluorine resin.

10. The cable according to claim 5, further comprising:

wherein the plurality of electric wires and the at least one air tube are laid helically around the outer periphery of the core member.

11. The cable according to claim 5, wherein the plurality of electric wires include a power supply wire including an aggregate comprising insulated electric wires for electric power supply that are stranded together, and an inner sheath covering the aggregate together.

12. The cable according to claim 5, wherein the plurality of electric wires include a signal wire including a twisted wire pair aggregate comprising twisted wire pairs for signal transmission that are stranded together, and an inner sheath covering the twisted wire pair aggregate together.

13. The cable according to claim 5, wherein the sheath includes an inner layer sheath comprising a urethane resin, and an outer layer sheath provided around an outer periphery of the inner layer sheath to protect the inner layer sheath.

14. The cable according to claim 13, wherein the inner layer sheath and the outer layer sheath are adhered to each other.

15. The cable according to claim 13, wherein the outer layer sheath comprises a polyvinyl chloride resin.

16. The cable according to claim 13, wherein a thickness of the inner layer sheath is not less than a thickness of the outer layer sheath.

17. The cable according to claim 5, wherein an entirety of the hollow portion is devoid of an other member.

18. The cable according to claim 5, wherein the hollow portion is located at a center of the core member main body.

19. The cable according to claim 5, wherein the core member main body and the coating layer are in contact with each other to move integrally as one piece.

* * * * *